US007562518B2

(12) United States Patent
Daniels et al.

(10) Patent No.: US 7,562,518 B2
(45) Date of Patent: Jul. 21, 2009

(54) FLUID ACTIVATED CONNECTING PIN REMOVAL TOOL

(75) Inventors: Michael K. Daniels, Slave Lake (CA); Herb R. Gehrling, Slave Lake (CA)

(73) Assignee: Barlan Enterprises Inc., Alberta (CA)

( * ) Notice: Subject to any disclaimer, the term of this patent is extended or adjusted under 35 U.S.C. 154(b) by 239 days.

(21) Appl. No.: 11/656,745

(22) Filed: Jan. 23, 2007

(65) Prior Publication Data

US 2007/0193247 A1 Aug. 23, 2007

(30) Foreign Application Priority Data

Feb. 21, 2006 (CA) ..... 2537172

(51) Int. Cl.
*B21L 21/00* (2006.01)
*B21L 9/06* (2006.01)

(52) U.S. Cl. ..... 59/7; 59/11; 59/35.1; 29/252

(58) Field of Classification Search ..... 59/7, 59/11, 35.1; 29/252
See application file for complete search history.

(56) References Cited

U.S. PATENT DOCUMENTS 2,020,162 A * 11/1935 Rodgers ..... 59/7
2,387,551 A * 10/1945 Abramson et al. ..... 29/252
3,553,960 A * 1/1971 Ellefson ..... 59/11
3,979,812 A 9/1976 Kuenzig
4,027,471 A * 6/1977 Lipp et al. ..... 59/7
4,030,286 A 6/1977 Gibilaro
4,063,412 A * 12/1977 Bruzek ..... 59/7
4,235,073 A 11/1980 Tracy
4,339,961 A 7/1982 Grillot et al.
4,506,501 A * 3/1985 DeVall et al. ..... 59/7
4,531,355 A 7/1985 Numakura
4,833,875 A 5/1989 Buermann, Jr. et al.
5,203,158 A 4/1993 Bowers
5,222,354 A 6/1993 Rothstein
5,463,862 A 11/1995 Reisenauer
5,713,117 A 2/1998 Bliss
6,453,657 B1 * 9/2002 Teravainen ..... 59/11
6,951,096 B2 * 10/2005 Maguire et al. ..... 59/7

OTHER PUBLICATIONS

Motion Pro, Inc., Motion Pro Chain Tool, available at http://www.motionpro.com/motorcycle/tools/chain, available at least as early as 2004.
Berco, Hydraulic portable presses, available at http://www.berco.com/html/pp100.html, available as early as 2004.

* cited by examiner

*Primary Examiner*—David B Jones
(74) *Attorney, Agent, or Firm*—Davis & Bujold, P.L.L.C.

(57) ABSTRACT

A fluid activated connecting pin removal tool, includes a body defining a first cavity adapted to receive a portion of a work piece and a second cavity positioned substantially perpendicular to and intersecting the first cavity. When a fluid activated cylinder is mounted to the body in a first orientation relative to the second cavity, expansion of the fluid activated cylinder results in a piston extending from the cylinder into the first cavity in which the work piece is positioned to exert a force upon a connecting pin connecting portions of the work piece. When the fluid activated cylinder is mounted to the body in a second orientation relative to the second cavity, the secondary cavity serves as a storage compartment for the fluid activated cylinder.

6 Claims, 3 Drawing Sheets

FLUID ACTIVATED CONNECTING PIN REMOVAL TOOL

This application claims priority from Canadian Application Serial No. 2,537,172 filed Feb. 21, 2006.

FIELD OF THE INVENTION

The present invention relates to a fluid activated connecting pin removal tool, such as are used to remove connecting pins linking sections of endless track on tracked vehicles.

BACKGROUND OF THE INVENTION

The U.S. Pat. No. 5,463,862 (Reisenauer 1995) is an example of a fluid activated connecting pin removal tool.

SUMMARY OF THE INVENTION

According to the present invention there is provided a fluid activated connecting pin removal tool, which includes a body defining a first cavity adapted to receive a portion of a work piece and a second cavity positioned substantially perpendicular to and intersecting the first cavity. When a fluid activated cylinder is mounted to the body in a first orientation relative to the second cavity, expansion of the fluid activated cylinder results in a piston extending from the cylinder into the first cavity in which the work piece is positioned to exert a force upon a connecting pin connecting portions of the work piece. When the fluid activated cylinder is mounted to the body in a second orientation relative to the second cavity, the secondary cavity serves as a storage compartment for the fluid activated cylinder.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
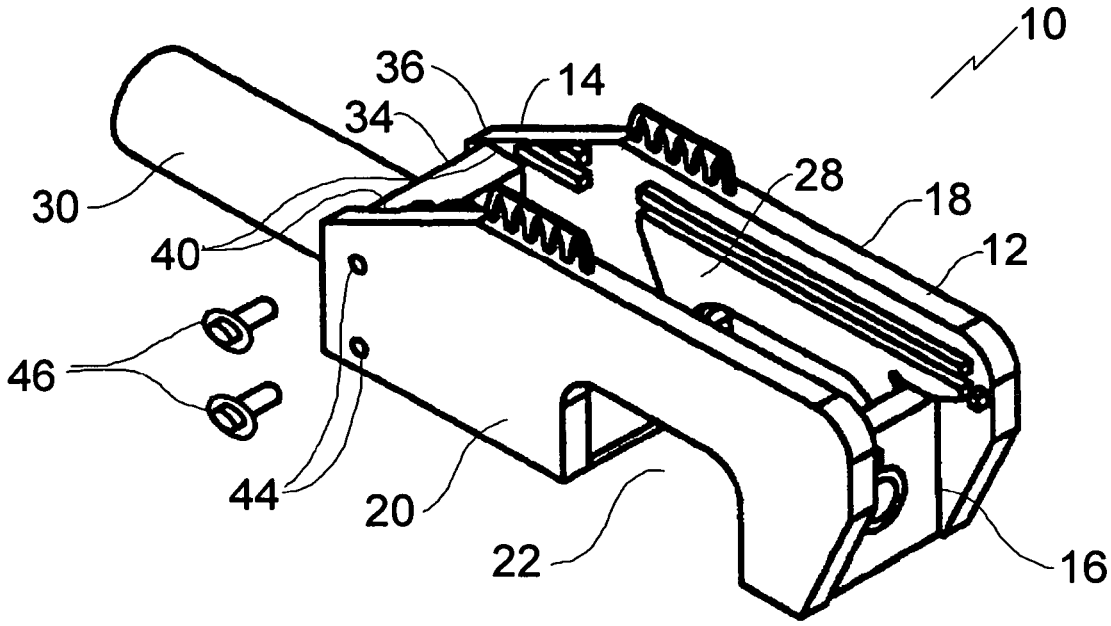
FIG. 1 is a perspective view of a fluid activated connecting pin removal tool constructed in accordance with the teachings of the present invention with a fluid activated cylinder positioned in a first orientation.

The preferred embodiment, a fluid activated connecting pin removal tool generally identified by reference numeral 10, will now be described with reference to FIGS. 1 through 5.

Structure and Relationship of Parts:

Referring to FIG. 1, fluid activated connecting pin removal tool 10 includes a body 12 having a first end 14, a second end 16, and opposed walls 18 and 20 that extend between first end

Figure 2:
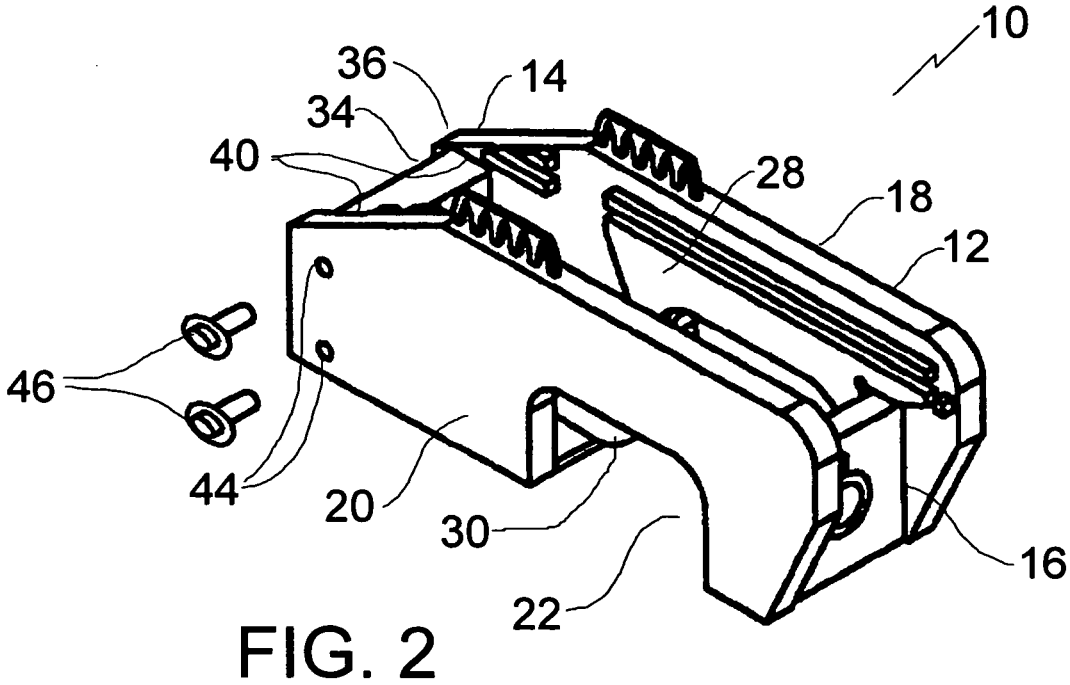
FIG. 2 is a perspective view of the fluid activated connecting pin removal tool illustrated in FIG. 1, with the fluid activated cylinder positioned in a second orientation.
Figure 3:
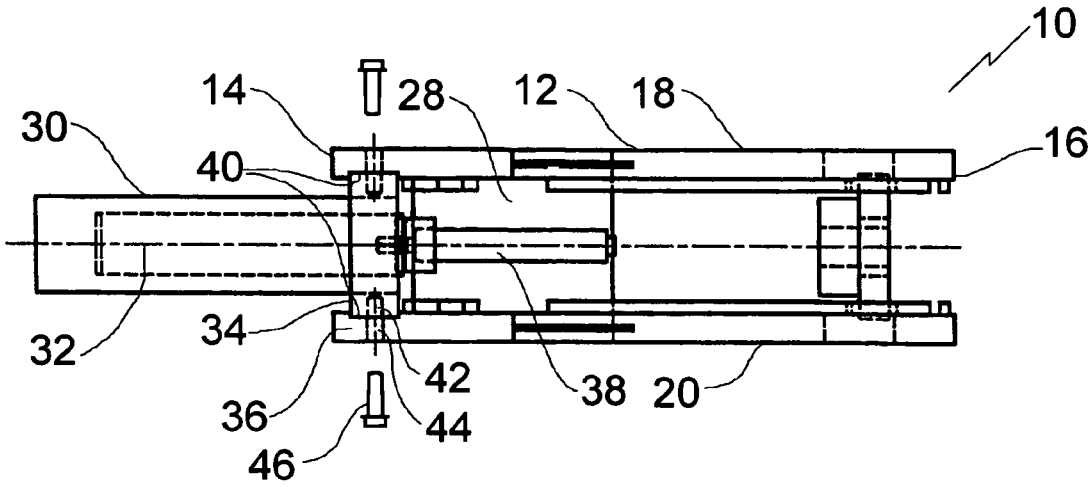
FIG. 3 is a top plan view of the fluid activated connecting pin removal tool illustrated in FIG. 1.

14 and second end 16. A first cavity 22 is adapted to receive a portion of a work piece (not shown) that is positioned such that it extends transversely through opposed walls 18 and 20 at second end 16. A second cavity 28 is positioned substantially perpendicular to and intersecting first cavity 22 extending longitudinally between opposed walls 18 and 20. Referring to FIG. 3, there is also a fluid activated cylinder 30 that has a longitudinal axis 32 and a mounting flange 34 positioned transversely to longitudinal axis 32. A receiver 36 is positioned at first end 14 of body 12 and is adapted to engage mounting flange 34 of fluid activated cylinder 30 in either a first orientation, as shown in FIG. 1, or a second orientation, as shown in FIG. 2, relative to second cavity 28. In the first orientation, referring to FIG. 4, upon expansion of fluid activated cylinder 30, a piston 38 extends from cylinder 30 into first cavity 22 in which the work piece is positioned to exert a force upon a connecting pin connecting portions of the work piece (not shown). In the second orientation, referring to FIG. 2, secondary cavity 28 serves as a storage compartment for fluid activated cylinder 30.

Figure 4:
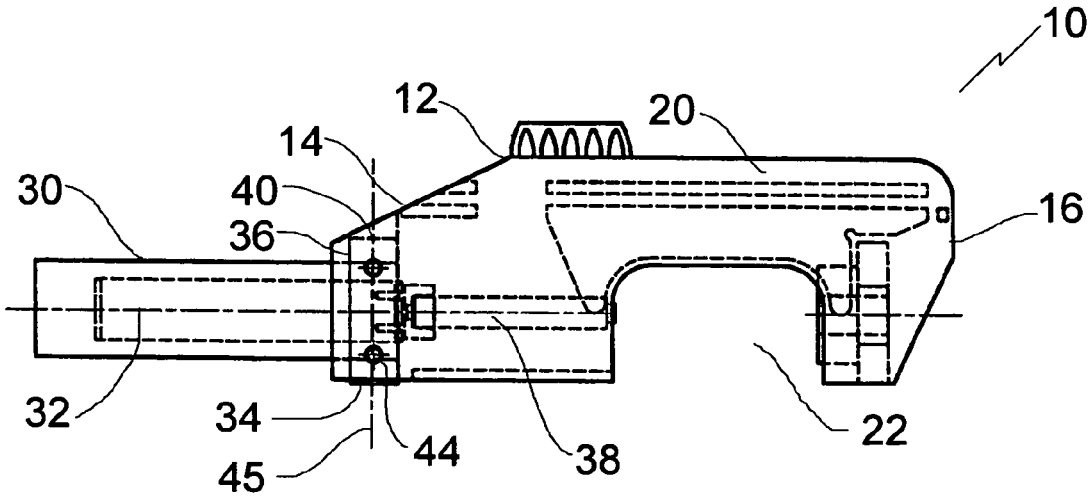
FIG. 4 is a side elevation view of the fluid activated connecting pin removal tool illustrated in FIG. 1.
Figure 5:
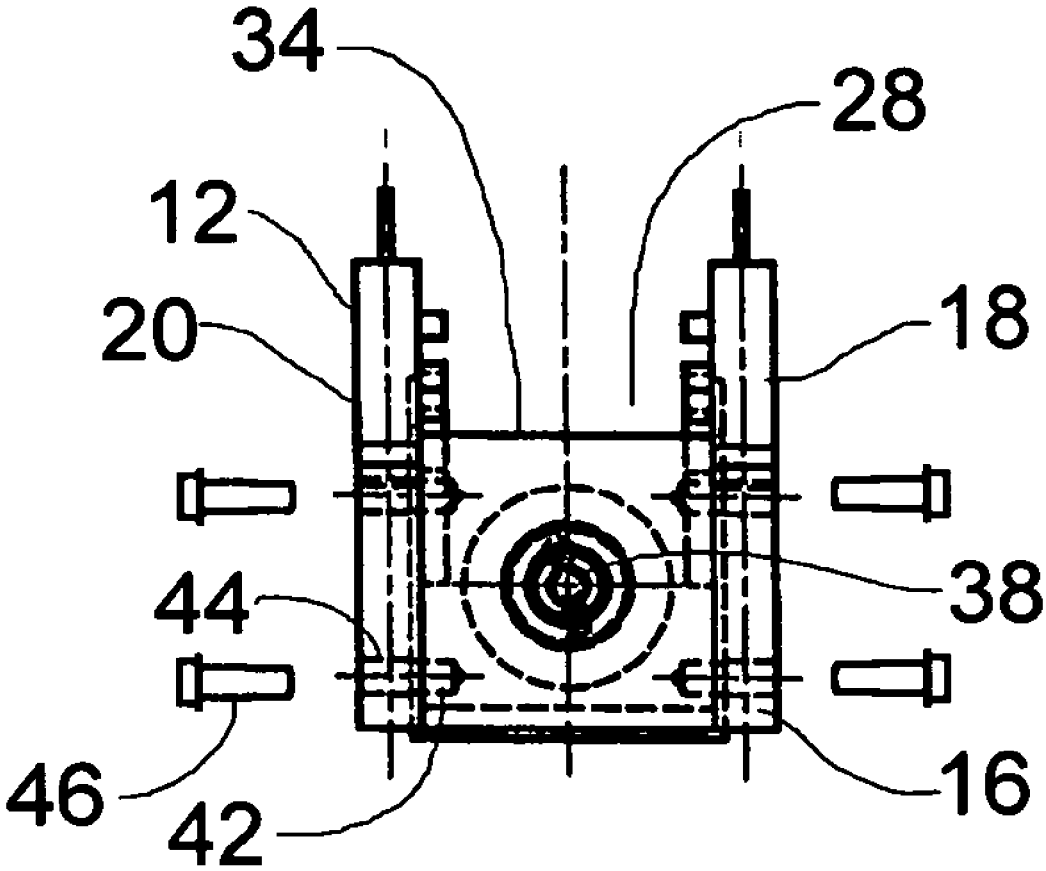
FIG. 5 is an end elevation view of the fluid activated connecting pin removal tool illustrated in FIG. 1.

Referring now to FIG. 3, mounting flange 34 is rectangular and receiver 36 has opposed channels 40 adapted to receive mounting flange 34. Mounting flange 34 also has first bolt receiving apertures 42 perpendicular to longitudinal axis 32 of fluid activated cylinder 30. Referring to FIG. 4, body 12 has second bolt receiving apertures 44 extending perpendicular to the longitudinal axis 45 of opposed channels 40. Referring to FIG. 5, mounting flange 34 of fluid activated cylinder 30 is secured to receiver 36 of body 12 in both the first orientation and the second orientation by sliding mounting flange 34 into opposed channels 40 and extending bolts 46 through second bolt receiving apertures 44 of body 12 and into first bolt receiving apertures 42 of mounting flange 34.

Operation:

Referring to FIGS. 1 through 5, fluid activated connecting pin removal tool 10 is provided as described above. Referring to FIG. 2, tool 10 is transported in the second position, with fluid activated cylinder 30 positioned in secondary cavity 28. Referring to FIG. 3, tool 10 is changed to the first position by removing bolts 46 from first and second bolt receiving apertures 42 and 44, respectively, and removing mounting flange 34 from receiver 36 by lifting cylinder 30 such that flange 34 slides out of opposed channels 40. Cylinder 30 is then reversed, and remounted by sliding mounting flange 34 into opposed channels 40, and inserting bolts 46 into first and second bolt receiving apertures 42 and 44. Referring to FIG. 4, the work piece is then positioned within first cavity 22 (not shown), and piston 38 is extended from cylinder 30 into first cavity 22 to exert a force upon a connecting pin connecting portions (not shown) of the work piece. After the work is complete, the tool can then be reverted to the second position by reversing the above steps.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A fluid activated connecting pin removal tool, comprising:

a body defining a first cavity adapted to receive a portion of a work piece and a second cavity positioned substantially perpendicular to and intersecting the first cavity;

means for mounting a fluid activated cylinder to the body in a first orientation relative to the second cavity such that, upon expansion of the fluid activated cylinder, a piston extends from the cylinder into the first cavity in which the work piece is positioned to exert a force upon a connecting pin connecting portions of the work piece; and means for mounting the fluid activated cylinder to the body in a second orientation relative to the second cavity such that the second cavity serves as a storage compartment for the fluid activated cylinder.

2. The fluid activated connecting pin removal tool as defined in claim 1, wherein the fluid activated cylinder has a mounting flange and the body has a receiver adapted to engage the mounting flange in either the first orientation or the second orientation.

3. The fluid activated connecting pin removal tool as defined in claim 2, wherein the mounting flange is rectangular and the receiver has opposed channels adapted to receive the mounting flange, the opposed channels having a longitudinal axis, the mounting flange having first bolt receiving apertures perpendicular to the longitudinal axis of the fluid activated cylinder, the body having second bolt receiving apertures extending perpendicular to the longitudinal axis of the opposed channels, the mounting flange of the fluid activated cylinder being secured to the receiver of the body in both the first orientation and the second orientation by sliding the mounting flange into the opposed channels and extending bolts through the second bolt receiving apertures of the body and into the first bolt receiving apertures of the mounting flange.

4. The fluid activated connecting pin removal tool as defined in claim 1, wherein the body has a first end, a second end, and opposed walls that extend between the first end and the second end, the first cavity extending transversely through the opposed walls at the second end, the second cavity extending longitudinally between the opposed walls.

5. A fluid activated connecting pin removal tool, comprising:

a body having a first end, a second end, and opposed walls that extend between the first end and the second end, a first cavity adapted to receive a portion of a work piece extending transversely through the opposed walls at the second end and a second cavity positioned substantially perpendicular to and intersecting the first cavity extending longitudinally between the opposed walls;

a fluid activated cylinder having a longitudinal axis and mounting flange positioned transversely to the longitudinal axis;

a receiver positioned at the first end of the body and adapted to engage the mounting flange of the fluid activated cylinder in either a first orientation or a second orientation relative to the second cavity, in the first orientation, upon expansion of the fluid activated cylinder, a piston extends from the cylinder into the first cavity in which the work piece is positioned to exert a force upon a connecting pin connecting portions of the work piece, and in the second orientation the second cavity serves as a storage compartment for the fluid activated cylinder.

6. The fluid activated connecting pin removal tool as defined in claim 5, wherein the mounting flange is rectangular and the receiver has opposed channels adapted to receive the mounting flange, the opposed channels having a longitudinal axis, the mounting flange having first bolt receiving apertures perpendicular to the longitudinal axis of the fluid activated cylinder, the body having second bolt receiving apertures extending perpendicular to the longitudinal axis of the opposed channels, the mounting flange of the fluid activated cylinder being secured to the receiver of the body in both the first orientation and the second orientation by sliding the mounting flange into the opposed channels and extending bolts through the second bolt receiving apertures of the body and into the first bolt receiving apertures of the mounting flange.

* * * * *